United States Patent [19]

May

[11] Patent Number: 4,520,854

[45] Date of Patent: Jun. 4, 1985

[54] LOG SPLITTER

[76] Inventor: Jim May, 12110 SE. Pine, Portland, Oreg. 97216

[21] Appl. No.: 555,496

[22] Filed: Nov. 28, 1983

[51] Int. Cl.[3] ..... B27L 7/00

[52] U.S. Cl. ..... 144/193 A; 144/3 K

[58] Field of Search ..... 144/193 R, 193 A, 3 K, 144/366

[56] References Cited

U.S. PATENT DOCUMENTS

| | | | |
|---|---|---|---|
| 873,418 | 12/1907 | Eckenruth, Jr. | 144/193 A |
| 3,077,214 | 2/1963 | Brukner | 144/193 A |
| 4,141,396 | 2/1979 | McCallister | 144/193 A |
| 4,155,385 | 5/1979 | Lapointe | 144/193 A |
| 4,411,298 | 10/1983 | Ellingsen et al. | 144/193 A |
| 4,454,899 | 6/1984 | Myers, Jr. | 144/193 A |

FOREIGN PATENT DOCUMENTS

| | | | |
|---|---|---|---|
| 3029940 | 3/1982 | Fed. Rep. of Germany | 144/193 A |

*Primary Examiner*—W. D. Bray

*Attorney, Agent, or Firm*—Eugene M. Eckelman

[57] ABSTRACT

A longitudinal frame has wheeled support intermediate its ends and supports a splitting ram on its underside such that a log can be split while lying on the ground. The frame has an extension on the other end from the ram and such extension is arranged to receive a counterbalance for easily maneuvering the wheeled frame.

5 Claims, 3 Drawing Figures

LOG SPLITTER

BACKGROUND OF THE INVENTION

This invention relates to new and useful improvements in log splitters.

A common type of log splitter now on the market utilizes a longitudinal frame supported on wheels and having a wedge and ram combination on the top of the frame for engaging a log to be split. This type of structure requires that the log be lifted or otherwise moved onto the frame. Such of course requires considerable manual strength particularly when splitting heavy wood and it also takes considerable time in manipulating the wood pieces to be split.

SUMMARY OF THE INVENTION

According to the present invention and forming a primary objective thereof, a wood splitter is employed that utilizes a longitudinal frame having the splitting means workable on the underside thereof whereby the splitter is capable of splitting a log lying on the ground.

Another object is to provide a log splitter of the type described having wheeled support and a counterbalance arrangement on said wheeled support such that one man can readily maneuver the splitter relative to a log on the ground. Also, the power unit for the apparatus can be used as a part of the counterbalance.

In carrying out the objectives of the invention, a longitudinal frame is provided having an abutment on the underside thereof and also having a wedge-shaped or splitting ram operating on the underside in combination with the abutment for splitting a log. The frame has wheeled support and includes a frame extension beyond the wheels whereby counterbalance means can be employed to facilitate balance of the frame and easy lifting of the ram end for positioning the splitter over a log lying on the ground.

The invention will be better understood and additional objects and advantages will become apparent from the following description taken in connection with the accompanying drawings.

DETAILED DESCRIPTION OF A PREFERRED EMBODIMENT

Figure 3:
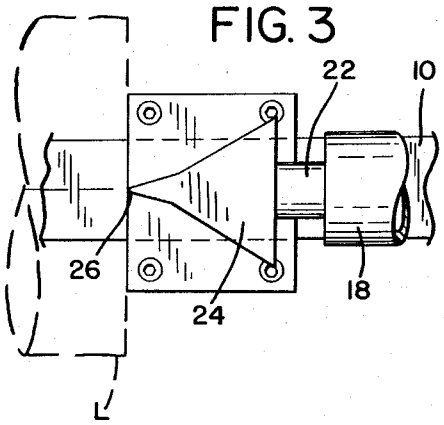
FIG. 3 is a fragmentary bottom plan view taken on the line 3—3 of FIG. 1.
Figure 2:
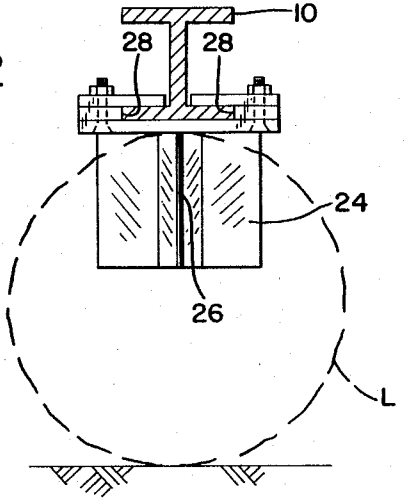
FIG. 2 is a cross sectional view of the splitter taken on the line 2—2 of FIG. 1.
Figure 1:
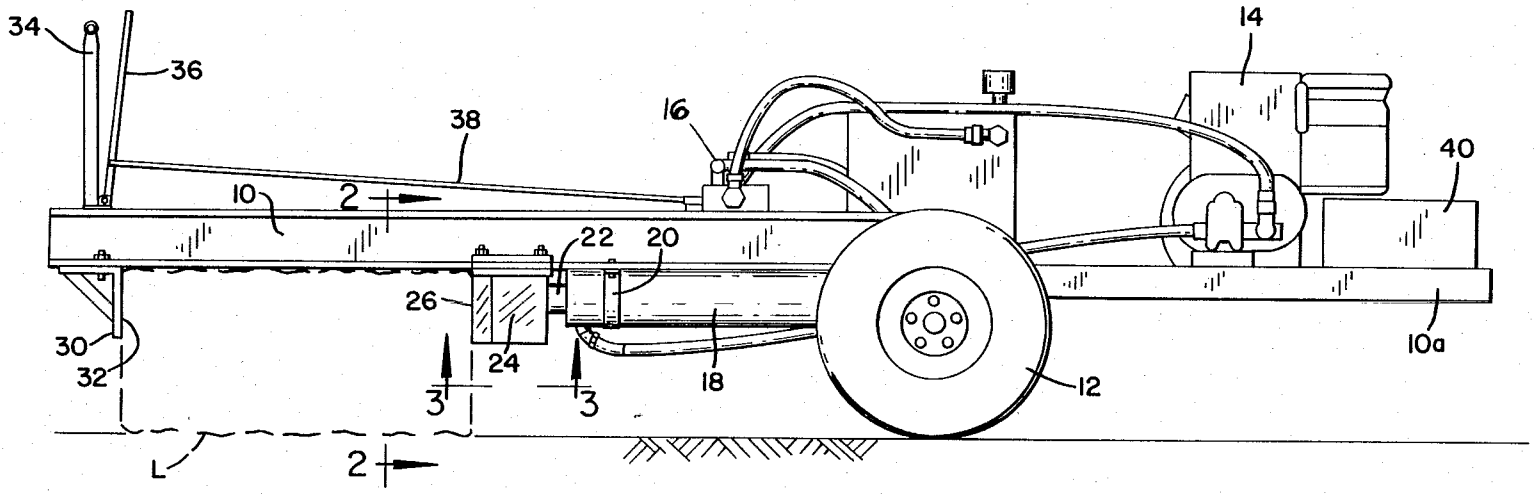
FIG. 1 is a side elevational view of a log splitter embodying features of the present invention.

According to the present invention, the splitter of the invention comprises a longitudinal frame 10 having support on a pair of wheels 12. The frame has a rear extension 10*a* that supports a power unit 14 and a hydraulic unit 16 operated by the motor 14 to drive a two-way ram 18 supported integrally by clamp means 20 on the underside of the frame 10 in parallel relation therewith. The piston rod 22 of the ram has an integral splitting head 24. This head is tapered to a front splitting edge 26. In a preferred construction, frame 10 comprises an I-beam and the head 24 has opposed grooves 28 receiving flanges of the I-beam to provide stable guided sliding support for the splitting head 24 longitudinally of the frame.

The forward end of the frame 10 has a depending heavy duty abutment 30 with a flat rearwardly facing surface 32. Also disposed at the forward end of the frame is operator control means comprising a handle 34 by means of which an operator can maneuver the splitter on its wheels. Abutment 30 is of a depending dimension such that it will serve as a foot when the splitter is not in use and prevent engagement of the head 24 with the ground in a rest position of the splitter. The operator control means also includes a pivoted operating lever 36 adjacent the handle 34 and connected to the hydraulic mechanism by linkage 38 to control the hydraulic control mechanism in the two-way functioning of the ram.

The frame extension 10*a* is arranged to support counterbalance means 40. This counterbalance means may comprise installed metal weights or also may merely comprise weights generally readily accessible to the operator such as rocks, bricks, etc. The weight of the counterbalance means 40 can be preselected such that the frame is closely counterbalanced whereby very little or no force is required to lift the front of the splitter. The power unit 14 as well as some of the hydraulic drive mechanism 16 and other parts can also be disposed rearwardly of the wheels to assist in the counterbalance function.

In the use of the present invention, the operator moves the splitter to the site of the log L and by maneuvering the splitter over the log, he can readily split the log without lifting the log onto the apparatus. The splitting ram, being under the frame, provides greater safety than those with the top loaded log, and furthermore for safety sake the operator need not hold the log in position with his hands. Generally, the operator can roll or position the log with his foot and then move his foot out of the way when the ram is operating. The frame can be held down on the log to steady it while the ram is advancing.

It is to be understood that the form of my invention herein shown and described is to be taken as a preferred example of the same and that various changes in the shape, size and arrangement of parts may be resorted to without departing from the spirit of my invention, or the scope of the subjoined claims. For example, the abutment 30 may include the wedge splitting means and the ram may have a flat pushing head. However, the arrangement shown is preferred since the log will remain stationary when split rather than being pushed out of the machine. The split log will thus remain in a stationary position and if it is to be split again, it is merely necessary to maneuver the machine a small amount for the next operation.

Having thus described my invention, I claim:

1. A log splitter comprising a longitudinal frame having opposite ends, operator control means adjacent one end of said frame, wheel means adjacent the other end of said frame whereby the splitter is maneuverable to position said frame over a log to be split, and abutment and powered ram means secured on the underside of said frame in depending relation and arranged to split a log therebetween after maneuvering the splitter over the log, said operator control means comprising upright operator grip means which allows the operator to maneuver the splitter, said operator control means also including a control for said powered ram means.

2. The log splitter of claim 1 wherein said frame extends longitudinally beyond said wheel means opposite from said operator control means, said splitter including counter-balance means on the opposite extending end whereby to provide easy maneuverability of said splitter.

3. The log splitter of claim 1 wherein said powered ram means includes a drive motor, said frame extending longitudinally beyond said wheel means opposite from said operator control means, said drive motor being mounted on said frame on the opposite extending end whereby to serve as a counterbalance and provide easy maneuverability of said splitter.

4. A log splitter comprising a longitudinal frame having opposite ends, wheel means supporting said frame on a supporting surface, an abutment secured adjacent one end of said frame, a powered ram on said frame arranged to move toward and away from said abutment, one of said abutment and ram having a wedge-shaped portion for splitting a log disposed between said abutment and ram, said abutment and ram being positioned on said frame such that said splitter is capable of splitting a log lying on a supporting surface, said frame extending longitudinally on both sides of said wheel means, and counterbalance means adjacent the opposite end of said frame from said abutment whereby to provide easy maneuverability of said splitter.

5. A log splitter comprising a longitudinal frame having opposite ends, wheel means supporting said frame on a supporting surface, an abutment secured adjacent one end of said frame, a powered ram on said frame arranged to move toward and away from said abutment, one of said abutment and ram having a wedge-shaped portion for splitting a log disposed between said abutment and ram, said abutment and ram being positioned on said frame such that said splitter is capable of splitting a log lying on a supporting surface, said powered ram including a drive motor, said frame extending longitudinally on both sides of said wheel means, said drive motor being mounted on said frame on the opposite end from said abutment whereby to serve as a counterbalance and provide easy maneuverability of said splitter.

* * * * *